US006187437B1

(12) United States Patent
Haider et al.

(10) Patent No.: US 6,187,437 B1
(45) **Date of Patent: *Feb. 13, 2001**

(54) PROCESS FOR MAKING HIGH DENIER MULTILOBAL FILAMENTS OF THERMOTROPIC LIQUID CRYSTALLINE POLYMERS AND COMPOSITIONS THEREOF

(75) Inventors: M. Ishaq Haider, Bernardsville; John Anthony Flint, Berkeley Heights; Michael Jaffe, Maplewood, all of NJ (US); Joseph J. DiBiase, Nazareth, PA (US); John Edward Cornetta, Chester, NJ (US)

(73) Assignee: Celanese Acetate LLC, Charlotte, NC (US)

( * ) Notice: Under 35 U.S.C. 154(b), the term of this patent shall be extended for 0 days.

This patent is subject to a terminal disclaimer.

(21) Appl. No.: 09/150,921

(22) Filed: Sep. 10, 1998

(51) Int. Cl.[7] ..... B32B 27/34
(52) U.S. Cl. ..... 428/395; 428/397; 428/398
(58) Field of Search ..... 128/395, 397, 128/398

(56) References Cited

U.S. PATENT DOCUMENTS

| | | | | |
|---|---|---|---|---|
| Re. 29,363 | * | 8/1977 | McKay | 57/140.3 |
| 4,041,689 | * | 8/1977 | Duncan et al. | 57/140.3 |
| 4,083,829 | * | 4/1978 | Calundann et al. | 260/47 C |
| 4,161,470 | * | 7/1979 | Calundann | 528/206 |
| 4,183,895 | | 1/1980 | Luise . | |
| 4,330,457 | * | 5/1982 | East et al. | 524/602 |
| 4,399,084 | * | 8/1983 | Sagawa et al. | 264/27 |
| 4,468,364 | | 8/1984 | Ide . | |
| 4,910,057 | | 3/1990 | Ide et al. . | |
| 5,057,368 | * | 10/1991 | Largman et al. | 428/397 |
| 5,069,970 | * | 12/1991 | Largman et al. | 428/373 |
| 5,141,811 | * | 8/1992 | Kawakami et al. | 428/364 |
| 5,246,776 | | 9/1993 | Meraldi et al. . | |
| 5,322,736 | * | 6/1994 | Boyle et al. | 428/397 |
| 5,427,165 | | 6/1995 | Balestra et al. . | |
| 5,626,961 | * | 5/1997 | Aneja | 428/397 |
| 5,821,319 | * | 10/1998 | Shibuya et al. | 528/170 |
| 5,834,119 | * | 11/1998 | Roop | 428/397 |
| 5,945,216 | * | 8/1999 | Flint et al. | 428/364 |

FOREIGN PATENT DOCUMENTS 4-333616 11/1992 (JP) .

OTHER PUBLICATIONS

J. Rheology 1992, vol. 36 (p. 1057–178).
J. Appl. Polym. Sci. 1995, vol. 55 (p. 1489–*1493).

* cited by examiner

*Primary Examiner*—William Krynski
*Assistant Examiner*—J. M. Gray
(74) *Attorney, Agent, or Firm*—Walter M. Douglas

(57) ABSTRACT

The present invention discloses and claims a novel process for the formation of high denier as-spun and heat-treated multilobal filaments of a thermotropic liquid crystalline polymer. Preferred embodiments include process for the formation of as-spun and heat treated octalobal monofilaments of a few wholly aromatic polyesters and polyesteramides. The process involves (a) heating of a thermotropic liquid crystalline polymer to above its melting transition temperature; (b) passing said molten polymer through an extrusion chamber equipped with an extrusion capillary having a multilobal cross-section to form a multilobal filament; and (c) winding the filament at a suitable draw-down. The filaments so formed are of at least 50 denier per filament (dpf) and feature essentially uniform molecular orientation across their cross-section. In a final optional step, the filaments are heat treated in stages to form filaments exhibiting excellent tensile properties. Both as-spun and heat-treated filaments feature remarkably good tensile properties comparable to those of round filaments. Most importantly, the multilobal filaments of this invention feature much superior adhesion properties than the conventional round filaments.

10 Claims, No Drawings

PROCESS FOR MAKING HIGH DENIER MULTILOBAL FILAMENTS OF THERMOTROPIC LIQUID CRYSTALLINE POLYMERS AND COMPOSITIONS THEREOF

BACKGROUND OF THE INVENTION

1. Field of the Invention

The present invention relates to processes for forming multilobal filaments of a thermotropic liquid crystalline polymer. Specifically, the present invention provides processes for forming as-spun and heat-treated high denier multilobal filaments of a variety of thermotropic liquid crystalline wholly aromatic polyesters and polyesteramides. This invention also relates to as-spun and heat-treated high denier multilobal filaments of thermotropic liquid crystalline polyesters and polyesteramides.

2. Description of the Prior Art

Thermotropic liquid crystalline polymers (LCPs) are an important class of polymers, which are generally wholly aromatic molecules containing a variety of heteroatom linkages including ester and/or esteramide linkages. Upon heating to sufficiently high temperature, LCPs melt to form a liquid crystalline melt phase (often referred to as "anisotropic phase") rather than an isotropic melt. Generally, LCPs consist of linear ("rigid rod") molecules that can line up to yield the desired liquid crystalline order. As a result, LCPs feature low melt viscosity and thus improved performance and processabilities.

Because LCPs orient to form "rigid rod" linear molecules, LCPs exhibit extremely high mechanical properties. Thus, it is well known in the art that LCPs can be formed into shaped articles, such as films, rods, pipes, fibers, and various other molded articles. In addition, it is also known in the art that LCPs, particularly in the fiber form, exhibit exceptionally high mechanical properties after a heat treatment process. However, all of the known methods in the art describe formation of only the low denier fibers, e.g., of about 10 deniers per filament (dpf), which exhibit high mechanical properties in their as-spun as well as heat-treated forms. Furthermore, there are no reports in the prior art that filaments having multilobal cross-section can be made from LCPs. More importantly, filaments of LCPs generally do not adhere to various other similar or dissimilar materials.

Thus it is an object of the present invention to provide a process for forming uniformly oriented high denier multilobal LCP filaments. The high denier filament means a filament of higher than 50 dpf.

It is also an object of the present invention to provide a process for forming high denier LCP multilobal filaments of higher than 50 dpf, which exhibit enhanced mechanical, thermal and chemical resistance properties in the as-spun as well as heat-treated form.

It is further an object of the present invention to provide a process for forming high denier LCP multilobal filaments, which exhibit properties comparable to those of low denier LCP round filaments (i.e., filaments of less than 10 dpf) in their as-spun as well as heat treated states.

It is also an object of the present invention to provide high denier LCP multilobal filaments of higher than 50 dpf having properties comparable to those of low denier LCP round filaments of less than 10 dpf.

Finally, it is an object of the present invention to provide high denier LCP multilobal filaments that feature improved adhesion properties.

It is high desirability to forming uniformly oriented high denier LCP filaments, which filaments exhibit enhanced mechanical, thermal and chemical resistance properties in the as-spun as well as heat-treated form. For example, high denier LCP filaments can replace steel wires in steel belted tires. Furthermore, since LCP filaments are of substantially lower density when compared with steel wires, LCP filaments are expected to feature properties superior to those exhibited by steel wires. In addition the prior art indicates that there is a real need for high denier LCP filaments that exhibit enhanced mechanical, thermal, and chemical resistance properties.

3. Prior Art

The following references are disclosed as background prior art.

U.S. Pat. No. 4,183,895 describes a process for treating anisotropic melt forming polymeric products. A process of heat treatment reportedly yielded fibers having enhanced mechanical properties, and the fiber tenacity was reported as being increased by at least 50% and to at least 10 grams per denier.

U.S. Pat. No. 4,468,364 describes a process for extruding thermotropic liquid crystalline polymers (LCPs). It is claimed that extrusion of an LCP through a die orifice having an L/D ratio of less than 2 (preferably 0), and at a draw-down ratio of less than 4 (preferably 1), yields filaments featuring high mechanical properties.

U.S. Pat. No. 4,910,057 describes a highly elongated member of substantially uniform cross-sectional configuration which is capable of improved service as a stiffening support in an optical fiber cable.

U.S. Pat. No. 5,246,776 describes an aramid monofilament and method of making the same.

U.S. Pat. No. 5,427,165 describes a reinforcement assemblage formed at least in part of continuous monofilaments of liquid crystal organic polymer(s). The polymers used therein are primarily aramids.

Japanese laid open Patent No. 4-333616 describes a method of manufacturing filaments of 50 to 2000 dpf from molten liquid crystalline polymers. The heat-treated mechanical properties of these filaments were significantly inferior to the properties reported for the corresponding lower denier filaments of 5 to 10 dpf

*J Rheology* 1992, Vol. 36 (p. 1057–1078) reports a study of the rheology and orientation behavior of a thermotropic liquid crystalline polyester using capillary dies of different aspect ratios.

J. Appl. Polym. Sci. 1995, Vol. 55 (p. 1489–1493) reports orientation distribution in extruded rods of a thermotropic liquid crystalline polyesters. The orientation function increases with increasing apparent shear rate from 166 to 270 $sec^{-1}$ but decreases with increasing apparent shear rate from 566 to 780 $sec^{-1}$.

All of the references described herein are incorporated herein by reference in their entirety.

SUMMARY OF THE INVENTION

Unexpectedly and surprisingly it has now been found that both as-spun and heat-treated high denier multilobal filaments of at least 50 denier per filaments can be made which feature essentially uniform molecular orientation across the filament cross-section. Furthermore, these high denier filaments feature remarkably good tensile properties, retaining at least 80 to 90 percent of the properties expected of conventional low denier –5 to 10 dpf filaments, which properties for high denier filament were hitherto unattainable by any of the known prior art references as briefly described hereinabove.

Thus, in accordance with this invention there is provided a process for forming a multilobal filament of a thermotropic liquid crystalline polymer having the following properties:

(i) denier of at least about 50 denier per filament;

(ii) tenacity of at least about 8 grams per denier;

(iii) modulus of at least about 450 grams per denier; and (iv) elongation of at least about 2 percent.

The process of the present invention is comprised of the following steps:

(a) heating a thermotropic liquid crystalline polymer to a temperature of at least about 15° C. above its melting transition to form a fluid stream of said thermotropic polymer, (b) passing said stream through a heated extrusion chamber, wherein said chamber is disposed with a suitable cylindrical orifice having a multilobal cross-section to form the multilobal filament of said polymer; and (c) winding said filament at a take-up speed of at least about 200 meters per minute and at suitable draw-down (DD) so as to form the filament of essentially uniform molecular orientation across its cross-section and having a denier of at least about 50 denier per filament.

In another aspect of the invention there is also provided a process for forming a heat-treated multilobal filament of a thermotropic liquid crystalline polymer having the following properties:

(i) denier of at least about 50 denier per filament;

(ii) tenacity of at least about 20 grams per denier;

(iii) modulus of at least about 600 grams per denier; and (iv) elongation of at least about 3 percent.

Thus in accordance with this aspect of the present invention, the process is comprised of the following steps:

(a) heating a thermotropic liquid crystalline polymer to a temperature of about 15° C. to about 50° C. above its melting transition to form a fluid stream of said polymer;

(b) extruding said stream of polymer through a heated cylindrical spinneret having at least one extrusion capillary of multilobal cross-section to form a multilobal filament;

(c) winding said filament at a take-up speed of at least about 200 meters per minute and at suitable draw-down so as to form a multilobal filament of essentially uniform molecular orientation across its cross-section and having a denier in the range of from about 50 to about 1000 denier per filament; and (d) heat-treating said filament at suitable temperature and pressure conditions for a sufficient period of time, optionally in the presence of an inert atmosphere, to form the heat-treated multilobal filament.

In yet another aspect of this invention there is also provided an as-spun multilobal filament of a thermotropic liquid crystalline polymer.

In a further aspect of this invention there is alsb provided a heat-treated multilobal filament of a thermotropic liquid crystalline polymer.

Other aspects and advantages of the present invention are described further in the following detailed description of the preferred embodiments thereof.

DETAILED DESCRIPTION OF THE INVENTION

In accordance with this invention there is provided a process for forming a multilobal filament of a thermotropic liquid crystalline polymer having the following properties:

(i) denier of at least about 50 denier per filament;

(ii) tenacity of at least about 8 grams per denier;

(iii) modulus of at least about 450 grams per denier; and (iv) elongation of at least about 2 percent.

The process of the present invention is comprised of the following steps:

(a) heating a thermotropic liquid crystalline polymer to a temperature of at least about 15° C. above its melting transition to form a fluid stream of said thermotropic polymer;

(b) passing said stream through a heated extrusion chamber, wherein said chamber is disposed with a suitable cylindrical orifice having a multilobal cross-section to form the multilobal filament of said polymer; and (c) winding said filament at a take-up speed of at least about 200 meters per minute and at suitable draw-down (DD) so as to form the filament of essentially uniform molecular orientation across its cross-section and having a denier of at least about 50 denier per filament.

In accordance with the process of the present invention, the preferred polymers are thermotropic liquid crystalline polymers. Thermotropic liquid crystal polymers are polymers which are liquid crystalline (i.e., anisotropic) in the melt phase. Thermotropic liquid crystal polymers include wholly aromatic polyesters, aromatic-aliphatic polyesters, aromatic polyazomethines, aromatic polyesteramides, aromatic polyamides, and aromatic polyester-carbonates. The aromatic polyesters are considered to be "wholly" aromatic in the sense that each moiety present in the polyester contributes at least one aromatic ring to the polymer backbone.

Specific examples of suitable aromatic-aliphatic polyesters are copolymers of polyethylene terephthalate and hydroxybenzoic acid as disclosed in Polyester X7G-A Self Reinforced Thermoplastic, by W. J. Jackson, Jr., H. F. Kuhfuss, and T. F. Gray, Jr., 30th Anniversary Technical Conference, 1975 Reinforced Plastics/Composites Institute, The Society of the Plastics Industry, Inc., Section 17-D, Pages 1–4. A further disclosure of such copolymer can be found in "Liquid Crystal Polymers: I. Preparation and Properties of p-Hydroxybenzoic Acid Copolymers," Journal of Polymer Science, Polymer Chemistry Edition, Vol. 14, pp. 2043–58 (1976), by W. J. Jackson, Jr. and H. F. Kuhfuss. The above-cited references are herein incorporated by reference in their entirety.

Aromatic polyazomethines and processes of preparing the same are disclosed in the U.S. Pat. Nos. 3,493,522; 3,493,524; 3,503,739; 3,516,970; 3,516,971; 3,526,611; 4,048,148; and 4,122,070. Each of these patents is herein incorporated by reference in its entirety. Specific examples of such polymers include poly(nitrilo-2-methyl-1,4-phenylenenitriloethylidyne-1,4-phenyleneethylidyne); poly(nitrilo-2-methyl-1,4-phenylene-nitrilomethylidyne-1,4-phenylenemethylidyne); and poly(nitrilo-2-chloro-1,4-phenylenenitrilomethylidyne-1,4-phenylene-methylidyne).

Aromatic polyesteramides are disclosed in U.S. Pat. Nos. 5,204,443, 4,330,457, 4,966,956, 4,355,132, 4,339,375, 4,351,917 and 4,351,918. Each of these patents is herein incorporated by reference in its entirety. Specific examples of such polymers include polymer formed from the monomers comprising 4-hydroxybenzoic acid, 2,6-hydroxynaphthoic acid, terephthalic acid, 4,4'-biphenol, and 4-aminophenol; and polymer formed from the monomers comprising 4-hydroxybenzoic acid, 2,6-naphthalene dicarboxylic acid, terephthalic acid, isophthalic acid, hydroquinone, and 4-aminophenol.

Preferred aromatic polyamides are those which are melt processable and form thermotropic melt phase as described hereinabove. Specific examples of such polymers include polymer formed from the monomers comprising terephthalic acid, isophthalic acid, and 2,2'-bis(4-aminophenyl) propane.

Aromatic polyester-carbonates are disclosed in U.S. Pat. No. 4,107,143, which is herein incorporated by reference in its entirety. Examples of such polymers include those consisting essentially of hydroxybenzoic acid units, hydroquinone units, carbonate units, and aromatic carboxylic acid units.

The liquid crystal polymers which are preferred for use in the process of the present invention are the thermotropic wholly aromatic polyesters. Specific examples of such polymers may be found in U.S. Pat. Nos. 3,991,013; 3,991,014; 4,057,597; 4,066,620; 4,075,262; 4,118,372; 4,146,702; 4,153,779; 4,156,070; 4,159,365; 4,169,933; 4,181,792; and 4,188,476, and U.K. Application No. 2,002,404. Each of these patents is herein incorporated by reference in its entirety.

Wholly aromatic polyesters which are preferred for use in the present invention are disclosed in commonly-assigned U.S. Pat. Nos. 4,067,852; 4,083,829; 4,130,545; 4,161,470; 4,184,996; 4,238,599; 4,238,598; 4,230,817; 4,224,433; 4,219,461; and 4,256,624. The disclosures of all of the above-identified commonly-assigned U.S. patents and applications are herein incorporated by reference in their entirety. The wholly aromatic polyesters disclosed therein typically are capable of forming an anisotropic melt phase at a temperature below approximately 350° C.

The wholly aromatic polyesters which are suitable for use in the process of the present invention may be formed by a variety of ester-forming techniques whereby organic monomer compounds possessing functional groups which upon condensation form the requisite recurring moieties are reacted. For instance, the functional groups of the organic monomer compounds may be carboxylic acid groups, hydroxyl groups, ester groups, acyloxy groups, acid halides, etc. The organic monomer compounds may be reacted in the absence of a heat exchange fluid via a melt acidolysis procedure. Accordingly, they may be heated initially to form a melt solution of the reactants with the reaction continuing as solid polymer particles are suspended therein. A vacuum may be applied to facilitate removal of volatiles formed during the final stage of the condensation (e.g., acetic acid or water).

In commonly-assigned U.S. Pat. No. 4,083,829, entitled "Melt Processable Thermotropic Wholly Aromatic Polyester," there is described a slurry polymerization process which may be employed to form the wholly aromatic polyesters which are preferred for use in the present invention. According to such a process, the solid product is suspended in a heat exchange medium. The disclosure of this patent has previously been incorporated herein by reference in its entirety.

When employing either the melt acidolysis procedure or the slurry procedure of U.S. Pat. No. 4,083,829, the organic monomer reactants from which the wholly aromatic polyesters are derived may be initially provided in a modified form whereby the usual hydroxy groups of such monomers are esterified (i.e., they are provided as lower acyl esters). The lower acyl groups preferably have from about two to about four carbon atoms. Preferably, the acetate esters of organic monomer reactants are provided.

Representative catalysts which optionally may be employed in either the melt acidolysis procedure or in the slurry procedure of U.S. Pat. No. 4,083,829 include dialkyl tin oxide (e.g., dibutyl tin oxide), diaryl tin oxide, titanium dioxide, antimony trioxide, alkoxy titanium silicates, titanium alkoxides, alkali and alkaline earth metal salts of carboxylic acids (e.g., zinc acetate), to gaseous acid catalysts such as Lewis acids (e.g., $BF_3$), hydrogen halides (e.g., HCl), and similar catalysts known to those skilled in the art. The quantity of catalyst utilized in a process is typically about 0.001 to about 1 percent by weight based upon the total monomer weight, and most commonly about 0.01 to about 0.2 percent by weight.

The wholly aromatic polyesters which are preferred for use in the present invention commonly exhibit a weight average molecular weight of about 10,000 to about 200,000, and preferably about 20,000 to about 50,000; for example, about 30,000 to about 40,000. Such molecular weight may be determined by commonly used techniques, for example, gel permeation chromatography or solution viscosity measurements. Other methods include end group determination via infrared spectroscopy on compression molded films or nuclear magnetic resonance spectroscopic (NMR) measurements of polymeric solutions or solid phase NMR of polymer powder or films. Alternatively, light scattering techniques in a pentafluorophenol solution (or equivolume solvent mixture of pentafluorophenol and hexafluoroisopropanol) may be employed to determine the molecular weight.

The wholly aromatic polyesters or polyesteramides additionally commonly exhibit an inherent viscosity (i.e., I.V.) of at least approximately 2.0 dL/g,; for example about 2.0 to about 10.0 dL/g, when dissolved in a concentration of 0.1 percent by weight in a 1:1 solvent mixture of hexafluoroisopropanol(HFIP)/pentafluorophenol (PFP) (v/v) at 25° C.

Especially preferred polymers for the process of this invention are wholly aromatic polyesters and polyesteramides. In preferred embodiments of this invention, specifically preferred polyesters are listed below:

a) The wholly aromatic polyester capable of forming an anisotropic melt phase at a temperature below approximately 350° C. consisting essentially of the recurring moieties I and II wherein:

I is

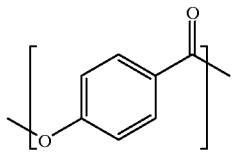

and

II is

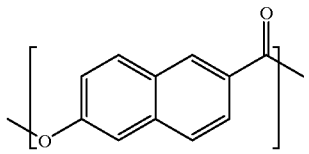

The wholly aromatic polyester as described above is disclosed in U.S. Pat. No. 4,161,470. The polyester comprises about 10 to about 90 mole percent of moiety I, and about 10 to about 90 mole percent of moiety II. In one embodiment, moiety II is present in a concentration of about 65 to about 85 mole percent, and preferably in a concentration of about 70 to about 80 mole percent; e.g., about 75 mole percent. In another embodiment, moiety II is present in a lesser proportion of about 15 to about 35 mole percent, and preferably in a concentration of about 20 to about 30 mole percent.

b) The wholly aromatic polyester capable of forming an anisotropic melt phase at a temperature below approximately 400° C. consisting essentially of the recurring moieties I, II, III, and VII wherein:

I is

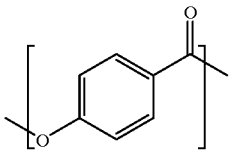

II is

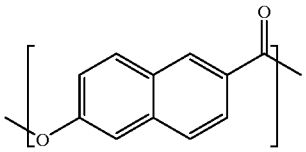

III is

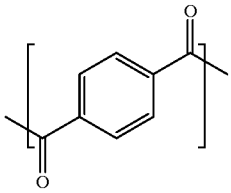

and
VII is

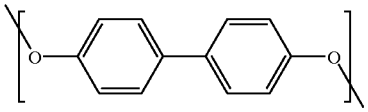

The polyester comprises about 40 to about 60 mole percent of moiety I, about 2 to about 30 mole percent of moiety II, and about 19 to about 29 mole percent each of moieties III and VII. In one of the preferred embodiments, the polyester comprises about 60 to about 70 mole percent of moiety I, about 3 to about 5 mole percent of moiety II, and about 12.5 to about 18.5 mole percent each of moieties III and VII.

The preferred polyesteramides of the process of the present invention are summarized below:

a) The wholly aromatic polyesteramide capable of forming an anisotropic melt phase at a temperature below approximately 360° C. consisting essentially of the recurring moieties II, III, and VI wherein:

II is

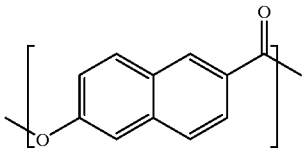

-continued

I is

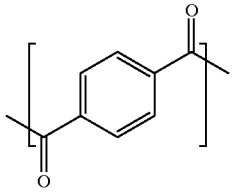

and
VI is

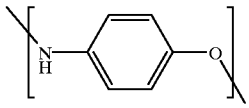

The wholly aromatic polyesteramide as described above is disclosed in U.S. Pat. No. 4,330,457, which is hereby incorporated herein by reference in its entirety. The polyesteramide comprises about 25 to about 75 mole percent of moiety II, about 37.5 to about 12.5 mole percent each of moieties III and VI. The polyesteramide preferably comprises about 40 to about 70 mole percent of moiety II, and about 15 to about 30 mole percent each of moieties III and VI. In one of the preferred embodiments of this invention, the polyesteramide comprises about 60 to about 65 mole percent of moiety II, and about 17.5 to about 20 mole percent each of moieties III, and VI.

b) The wholly aromatic polyesteramide capable of forming an anisotropic melt phase at a temperature below approximately 380° C. consisting essentially of the recurring moieties I, II, III, VII and VI wherein:

III is

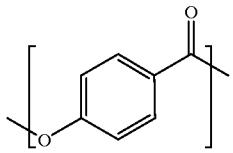

II is

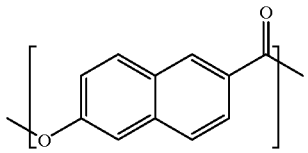

III is

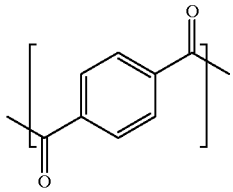

-continued

VII is

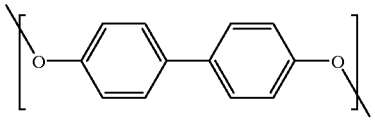

and

VI is

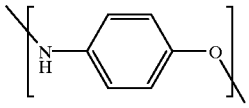

The wholly aromatic polyesteramide as described above is disclosed in U.S. Pat. No. 5,204,443, which is hereby incorporated herein by reference in its entirety. The polyesteramide comprises about 40 to about 70 mole percent of moiety I, about 1 to about 20 mole percent of moiety II, about 14.5 to about 30 mole percent of moiety III, about 7 to about 27.5 mole percent of moiety VII, and about 2.5 to about 7.5 mole percent of moiety VI.

c) The wholly aromatic polyesteramide capable of forming an anisotropic melt phase at a temperature below approximately 350° C. consisting essentially of the recurring moieties I, II, III, IV, V, and VI wherein:

I is

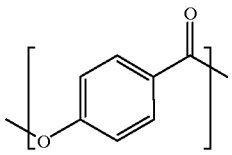

II is

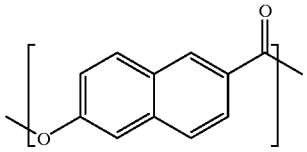

III is

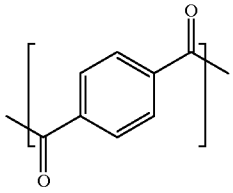

VI is

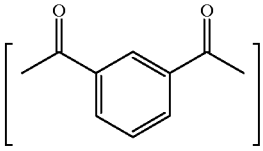

-continued

V is

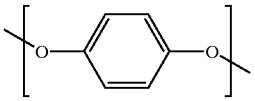

and

VI is

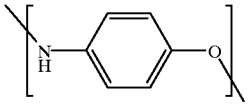

The polyesteramide as described above, comprises about 40 to about 70 mole percent of moiety I, about 10 to about 20 mole percent of moiety II, about 2.5 to about 20 mole percent of moiety III, about 0 to about 3 mole percent of moiety IV, about 12.5 to about 27.5 mole percent of moiety V and about 2.5 to about 7.5 mole percent of moiety VI.

According to the process of the present invention, a fluid stream of liquid crystal polymer is provided to any conventional extrusion apparatus provided that it contains an extrusion orifice having a multilobal cross-section. This is achieved by heating the thermotropic liquid crystalline polymer of the present invention to form a melt. Any of the known methods to heat the polymer to form a melt can be employed in this invention. The particular apparatus used is not critical to the operation of the process of the present invention, and any suitable apparatus may be used herein. One such apparatus which has been found to be suitable for use with thermotropic liquid crystal polymers employs a contact melting method so that melt residence time can be kept short and constant. The apparatus includes a heated surface against which a molded rod of liquid crystal polymer is pressed. The fluid stream of molten polymer is then introduced to the extrusion chamber inside of which are disposed a filter pack and an orifice having a multilobal cross-section. After being passed through the filter pack, the polymer melt is extruded through the orifice so as to form a multilobal filament. Thus, a plurality of such orifices may be disposed in an extrusion chamber if one desires to form a multilobal multifilaments.

In a preferred embodiment, the extrusion chamber is comprised of a single orifice multilobal chamber in which the polymer is heated to a temperature in the range of about 20° C. to about 50° C. above its melting transition.

After the fluid stream of the liquid crystal polymer is extruded through the orifice, the polymer forms an elongated shaped article having the polymer molecules oriented substantially parallel to the flow direction. The orientation of the polymer molecules can be confirmed by determining orientation angle by X-ray analysis. The extruded shaped articles in the form of filaments are then drawn down and taken-up on a filament spool. In accordance with the process of this invention, it is critical that the appropriate draw-down ratio be used to exploit maximum benefit from the practice of this invention. Thus, in a preferred embodiment, the draw-down ratio in the range of from about 4 to about 20 is employed. In a more preferred embodiment, the draw-down ratio in the range of from about 4 to about 15 is employed. The draw-down ratio (DD) as used herein is defined as the ratio of cross-sectional area of the orifice ($A_1$) to the cross-sectional area of the filament ($A_2$). This ratio is often also expressed as the ratio of the take-up speed of the filament ($V_2$) to the extrusion speed of the filament ($V_1$). Thus, the draw-down ratio, DD, may be expressed in terms of the following equation:

$$DD=A_1/A_2=V_2/V_1$$

Thus, in accordance with the process of the present invention, thermotropic liquid crystalline polymeric multilobal filaments having essentially uniform molecular orientation that exhibit unusually superior mechanical properties can be made. For example, by properly practicing the process of the present invention, it is now possible to obtain a high denier multilobal filament having hitherto unattainable properties. More specifically, it has now been found that multilobal filaments having a denier in the range of from about 100 to about 1000 denier per filament (dpf) can readily be made by following the process of this invention. In a preferred embodiment, multilobal filaments having a denier in the range of from about 150 to about 500 dpf can readily be made. In another preferred embodiment, filaments having a denier in the range of from about 180 to about 300 dpf can readily be made. The denier as used herein is defined as a weight in grams of 9,000 meters of filament. The dpf as used herein is the denier of an individual continuous filament.

The conditions of temperature and pressure under which the liquid crystal polymer can be extruded are not critical to the process of the present invention and can easily be determined by one of ordinary skill in the art. Typically, thermotropic polymers are extruded at a temperature of about 280° C. to about 400° C. and at a pressure of about 100 p.s.i. to about 5,000 p.s.i.

As discussed hereinabove, liquid crystal polymers have very stiff, rod-like molecules. In the quiescent state, the polymer molecules line up in local regions, thereby forming ordered arrays or domains. The existence of domain texture within the microstructure of a liquid crystal polymer may be confirmed by conventional polarized light techniques whereby a polarizing microscope utilizing crossed-polarizers is employed.

The mechanical properties of multilobal filaments produced in accordance with the process of the present invention can be improved still further by subjecting the articles to a heat treatment following extrusion. The articles may be thermally treated in an inert atmosphere (e.g., nitrogen, argon, helium). For instance, the article may be brought to a temperature about 10° C. to about 30° C. below the melting temperature of the liquid crystal polymer, at which temperature the filament remains as a solid object. The heat treatment times commonly range from a few minutes to a number of days, e.g., from 0.5 to 200 hours, or more. Preferably, the heat treatment is conducted for a time of about 1 to about 48 hours (e.g., about 24 to about 30 hours). The heat treatment improves the properties of the filament by increasing the molecular weight of the liquid crystalline polymer and increasing the degree of crystallinity.

Thus, in accordance with one of the preferred embodiments of the present invention, there is also provided a process for forming a heat-treated multilobal filament of a thermotropic liquid crystalline polymer having the following properties:

(i) denier of at least about 50 denier per filament;

(ii) tenacity of at least about 20 grams per denier;

(iii) modulus of at least about 600 grams per denier; and (iv) elongation of at least about 3 percent.

The process for forming such a multilobal filament is comprised of the following steps:

(a) heating a thermotropic liquid crystalline polymer to a temperature of about 15° C. to about 50° C. above its melting transition to form a fluid stream of said polymer;

(b) extruding said stream of polymer through a heated cylindrical spinneret having at least one extrusion capillary having a multilobal cross-section to form a multilobal filament;

(c) winding said filament at a take-up speed of at least about 200 meters per minute and draw-down ratio of from about 5 to about 40 so as to form a multilobal filament of essentially uniform molecular orientation across its cross-section and having a denier in the range of from about 50 to about 1000 denier per filament; and (d) heat-treating said filament at suitable temperature and pressure conditions for a sufficient period of time, optionally in the presence of an inert atmosphere, to form the heat-treated filament.

Any of the preferred thermotropic polyesters or polyesteramides described hereinabove may be used in this preferred embodiment. Furthermore, as described herein, the heat treatment can be carried out in stages at a final temperature of about 15° C. below the melting transition of the thermotropic polymer.

In another preferred embodiment of this invention there is also provided an as-spun multilobal filament of a thermotropic liquid crystalline polymer having the following properties:

(a) denier of at least about 50 denier per filament;

(b) tenacity of at least about 8 grams per denier;

(c) modulus of at least about 450 grams per denier; and (d) elongation of at least about 2 percent.

In a particularly preferred embodiment of this invention the denier of as-spun multilobal filament is in the range of from about 100 to about 1000 dpf. In a more particularly preferred embodiment of this invention the denier of as-spun multilobal filament is in the range of from about 150 to about 500 dpf. In a most particularly preferred embodiment of this invention the denier of as-spun multilobal filament is in the range of from about 180 to about 300 dpf.

In yet another preferred embodiment of this invention there is also provided a heat-treated multilobal filament of a thermotropic liquid crystalline polymer having the following properties:

(a) denier of at least about 50 denier per filament;

(b) tenacity of at least about 20 grams per denier;

(c) modulus of at least about 600 grams per denier; and (d) elongation of at least about 3 percent.

This invention is further illustrated by the following examples, which are provided for illustration purposes and in no way limit the scope of the present invention.

EXAMPLES (General)

In the Examples that follow, the following abbreviations are used:

HBA=4-Hydroxybenzoic acid

HNA=2,6-Hydroxynaphthoic acid

TA=Terephthalic acid

IA=Isophthalic acid

NDA=2,6-Naphthalene dicarboxylic acid

BP=4,4'-Biphenol

HQ=Hydroquinone

AA=1-Acetoxy4-acetamidobenzene

IV=Inherent viscosity dL/g=deciliters per gram; an unit of measure of IV wt. %=generally used to represent the concentration of a solution to measure IV—means grams of polymer in 100 mL of a solvent mixture.

wt %=weight percent

MV=Melt viscosity

DSC=Differential Scanning Calorimetry

T=Tenacity

M=Modulus

E=Elongation gpd=grams per denier

General Analytical Techniques Used for the Characterization of the Polymer

A variety of analytical techniques were used to characterize polymer(s) and the filaments formed according to the present invention, which included the following:

IV: The solution viscosity of the polymer samples, IV, was measured at 25° C. in a concentration of 0.1 wt. % solution in equal parts by volume of pentafluorophenol and hexafluoroisopropanol.

Mv: MV of polymer samples was measured using a Kayeness Melt Rheometer Model 2052 equipped with a Hastalloy barrel and plunger tip. The radius of the die orifice was 0.015 inch and the length was 1 inch. For the purpose of determining melt viscosity, a plot of viscosity vs. shear rate was generated by measuring the viscosities at shear rates of 56, 166, 944, 2388, and 8333 $sec^{-1}$, and viscosities at 100 and 1000 $sec^{-1}$ were interpolated.

DSC: DSC of polymer samples was performed on a Perkin Elmer 7700 Thermal Analysis System. In all runs the samples, sealed in aluminum pans, were heated or cooled at a rate of 20° C./min. under a nitrogen atmosphere. The DSC curves obtained from the second heating run were taken for the analysis.

Light Microscopy: Samples were prepared for microscopic analysis by thin sectioning using a glass knife microtome. The sections were examined by polarized light microscopy to observe morphological behavior at ambient temperatures.

Example 1

Example 1 demonstrates that the mechanical properties of an as-spun high denier multilobal filament of a liquid crystalline wholly aromatic polyester produced in accordance with the present invention are comparable to those of the round filament made by a conventional process.

Multilobal filaments were formed from a thermotropic liquid crystalline wholly aromatic polyester comprising HBA units and HNA units. (VECTRA™ A, commercially available from HNA Holdings, Inc., Charlotte, N.C.) This polymer exhibited a melting temperature of 280° C. and an inherent viscosity of 6.30 dL/g when measured in a concentration of 0.1 percent by weight solution in equal parts by volume of pentafluorophenol and hexafluoroisopropanol at 25° C.

A sample of the polymer was dried overnight at 130° C. under vacuum. The polymer was melted in a 1 inch diameter extruder, and the extrudate was metered using a conventional polymer meter pump to the spinning pack where it was filtered through 50/80 shattered metal. The melt was then extruded through a single hole spinneret of octalobal cross-section. Crossflow quench was applied to the emerging octalobal filament to provide cooling and a stable spinning environment. The quench was situated 4 cm below the spinneret face, and was 120 cm long by 15 cm wide. The quench flow rate at the top was 30 mpm (0.5 mpsec). The octalobal monofilament of 220 denier was dressed either with water or with a spinning finish before passing around a system of godets which controlled the take-up speed. It was finally taken up on a Sahm spool winder.

Mechanical properties of the monofilaments produced in accordance with this Example 1 were measured in accordance with ASTM D3822, and the results are listed in Table I. For purposes of comparison, round monofilaments were also extruded in the manner described above using a cylindrical spinneret. The mechanical properties of both round and octalobal filaments are listed in Table I.

TABLE I

| Sample No. | Draw-Down | Tenacity (gpd) | Modulus (gpd) | Elongation (%) |
|---|---|---|---|---|
| Octalobal 1 | 6.2 | 10 | 577 | 2 |
| Round 2 | 6.2 | 9 | 615 | 1.8 |

Example 2

Octalobal monofilaments of 220 denier produced in accordance with Example 1 were subjected to a heat treatment in stages as follows. Heat treatment of short lengths of the monofilament was carried out on racks under zero tension in a flow of dry nitrogen using a programmed temperature profile. The programmed temperature profiles of each of the heat treatment of octalobal monofilaments are listed in Table II. The heat-treated octalobal monofilament was tested at 10 inch gauge length; 20% strain rate and 10 filament break. Following heat treatment, the mechanical properties of the octalobal monofilaments were measured and are listed in Table II. For comparison mechanical properties of round filaments produced under similar conditions are also listed in Table II.

The measurements were made using the same tests as in Example 1. The data demonstrate the increase in properties, which is obtained by subjecting the octalobal monofilaments to staged heat treatment conditions.

TABLE II

| Sample Number | Preheat Condition | Heat Treatment Condition | Draw-Down | Den. (g) | Ten. (gpd) | Mod. (gpd) | Elong. (%) |
|---|---|---|---|---|---|---|---|
| Octalobal 1 | 230° C./2 hr | 8 hr, hold @ 270° C. | 6.2 | 220 | 25.7 | 654 | 3.3 |
| Round 2 | 230° C./2 hr | 8 hr, hold @ 270° C. | 6.2 | 220 | 23.7 | 623 | 3.3 |

The results presented in Table II clearly demonstrates that octalobal filaments of comparable properties to those of round filaments can be readily made following the process conditions of the present invention.

Example 3

Examples 1 and 2 were repeated in this example except that the high denier filaments of Vectra A polymer were formed. Table III summarizes the as-spun and heat treated properties of the Octalobal filaments.

TABLE III

Heat Treated Properties for High Denier Octalobal Vectra A Monofils

| Sample Number | Heat Treatment Condition | Jet Size (Draw-Down) | Den. (g) | Ten. (gpd) | Mod. (gpd) | Elong. (%) |
|---|---|---|---|---|---|---|
| 38538-26-10 | As-Spun (Control) | 0.015" | 221 | 10.0 | 597 | 2.00 |
| 38543-34-1 | 230° C./2 hr; 2702 C./8 hr | (6.2) | 222 | 21.9 | 599 | 3.20 |
| 38592-26-11 | As-Spun (Control) | 0.015" | 328 | 9.4 | 537 | 2.10 |
| 38543-34-2 | 230° C./2 hr; 270° C./8 hr | (6.2) | 327 | 20.6 | 564 | 3.19 |
| 38592-26-12 | As-Spun (Control) | 0.015" | 432 | 9.8 | 559 | 2.20 |
| 38543-34-3 | 230° C./2 hr; 270° C./8 hr | (6.2) | 430 | 19.9 | 596 | 3.17 |
| 38592-26-13 | As-Spun (Control) | 0.015" | 539 | 8.3 | 430 | 2.20 |
| 38543-34-4 | 230° C./2 hr; 270° C./8 hr | (6.2) | 532 | 18.4 | 536 | 3.22 |

Example 4

Example 4 demonstrates that octalobal filaments produced in accordance with Example 1 generally exhibit superior finish uptake when compared with the round filaments produced by the conventional methods.

Octalobal filaments of about 200 dpf were produced in accordance with Example 1 and were dressed with various levels of finish. In all cases the finish was applied during spinning as described in Example 1. The finish was applied in isopropanol (IPA) solvent. After the filaments were dried, the amount of finish uptake onto the filaments was measured by an extraction method. The extraction results are listed in Table IV.

TABLE IV

Finish uptake for 200 dpf as-spun LCP monofilaments

| Monofilament Cross-Section | FOF* (Target 0.5%) | FOF* (Target 1.0%) | FOF* (Target 1.5%) |
|---|---|---|---|
| Round | 0.2 | 0.5 | 0.6 |
| Octalobal | 0.5 | 0.8 | 1.2 |

*FOF = Percent (by weight) finish on filaments, measured by the extraction method Target FOF=Amount of finish applied during spinning using a solution comprising about 10 wt % finish and about 90 wt % IPA. The results presented in Table IV clearly demonstrates that octalobal filaments produced in accordance with the process of the present invention feature remarkably superior retention of the finish than the round filaments produced by conventional methods.

Example 5

Example 5 demonstrates that the octalobal filaments produced in accordance with the process of the present invention exhibit superior adhesion properties related to the round filaments produced by conventional methods.

Octalobal filaments of about 200 dpf produced in accordance with Example 4, and were further treated with two epoxy based predip compositions and two Resorcinol Formaldehyde Latex (RFL) adhesive recipes by methods known to those skilled in the art. The composition of Predip A was 4.0% by weight epoxy. Predip B was composed of 1.6% by weight epoxy and 4.1% by weight Block Isocyanurate. The RFL compositions were as following: For RFL-1, the Formaldehyde to Resorcinol molar ratio (F/R) was 1.7 and the Resin to Latex weight ratio (R/L) was 0.22. For RFL-2, the Formaldehyde to Resorcinol molar ratio (F/R) was 2.0 and the Resin to Latex weight ratio (R/L) was 0.17. RFL-2 also contained 10% by weight Block Isocyanurate in its composition. The adhesion of RFL treated filaments to rubber was measured by a H-Test (Peak). The results are listed in Table V.

For RFL-1, the Formaldehyde to Redsorcinol molar ratio (F/R) was 1.7 and the Resin to Latex weight ratio (R/L) was 0.22.

For RFL-2 the Formaldehyde to Resorcinol molar ratio (F/R) was 2.0 and the Resin to Latex weight ratio was 0.17. RFL-2 also contained about 10% by weight Block Isocyanurate.

The adhesion of RFL treated filaments to rubber was measured by an H-test (Peak). The results are given in Table V.

TABLE V

Rubber adhesion data for 200 dpf LCP monofilaments

| Sample | Predip Composition | RFL | FOF (%) | H-Peak Values (lbs.) | H-Peak Values (Std.) |
|---|---|---|---|---|---|
| Octalobal | A | R1 | 0.5 | 15.54 | 1.18 |
| | A | R2 | 0.5 | 15.62 | 1.60 |
| | B | R1 | 0.5 | 12.58 | 1.25 |
| | B | R2 | 0.5 | 13.21 | 1.04 |
| Round | A | R1 | 0.5 | 9.96 | 1.91 |
| | A | R2 | 0.5 | 10.32 | 0.86 |
| | B | R1 | 0.5 | 9.83 | 1.15 |
| | B | R2 | 0.5 | 9.35 | 0.57 |
| Octalobal | A | R2 | 1.5 | 15.96 | 1.03 |
| Round | A | R2 | 1.5 | 14.58 | 3.40 |

RFL = Resorcinol Formaldehyde Latex
R1:F/R = 1.7 mole ratio; R/L = 0.22 weight ratio (Where F = Formaldehyde and R = Resorcinol)
R2: R/L = 2.0 mole ratio; R/L = 0.17 weight ratio;

Block Isocyanurate=10 wt %. (Where R=Resin and L=Latex)

The data presented in Table V clearly demonstrate that octalobal filaments feature much superior adhesion properties than compared with round filaments.

Although the invention has been illustrated herein by certain of the preceding examples, it is not to be construed as being limited thereby; but rather, the invention encompasses the generic area as hereinbefore disclosed. Various modifications and embodiments can be made without departing from the spirit and scope thereof

What is claimed is:

1. An as-spun multilobal filament of a thermotropic liquid crystalline polymer having the following properties:

(a) denier higher than 50 denier per filament;

(b) tenacity of at least about 8 grams per denier;

(c) modulus of at least about 450 grams per denier; and (d) elongation of at least about 2 percent.

2. The filament as set forth in claim 1, wherein said thermotropic liquid crystalline polymer is selected from the group consisting of:

(i) a melt processable wholly aromatic polyester capable of forming an anisotropic melt phase at a temperature below approximately 350° C. consisting essentially of the recurring moieties I and II wherein:

I is

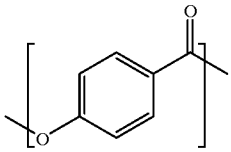

and
II is

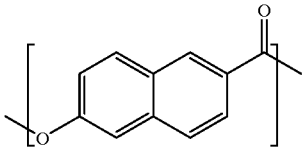

wherein said polyester comprises about 10 to about 90 mole percent of moiety I, and about 10 to about 90 mole percent of moiety II;

(ii) a melt processable wholly aromatic polyester capable of forming an anisotropic melt phase at a temperature below approximately 400° C. consisting essentially of the recurring moieties I, II, III, and VII wherein:

I is

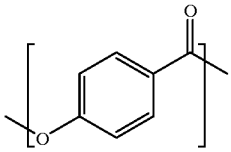

II is

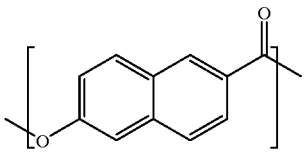

III is

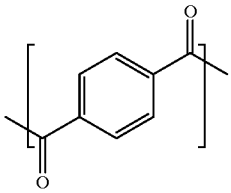

-continued and
VII is

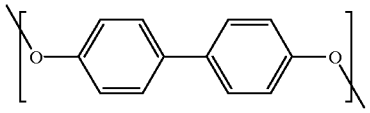

wherein said polyester comprises about 40 to about 70 mole percent of moiety I, about 1 to about 20 mole percent of moiety II, and about 14.5 to about 30 mole percent each of moieties III and VII;

(iii) a melt processable wholly aromatic polyesteramide capable of forming an anisotropic melt phase at a temperature below approximately 360° C. consisting essentially of the recurring moieties II, III, and VI wherein:

II is

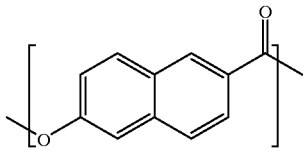

III is

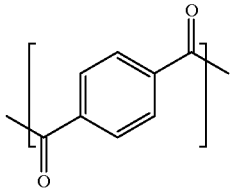

and
VI is

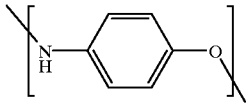

wherein said polyesteramide comprises about 40 to about 70 mole percent of moiety II, about 15 to about 30 mole percent each of moieties III, and VI;

(iv) a melt processable wholly aromatic polyesteramide capable of forming an anisotropic melt phase at a temperature below approximately 380° C. consisting essentially of the recurring moieties I, II, III, VII and VI wherein:

I is

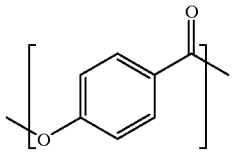

-continued

II is

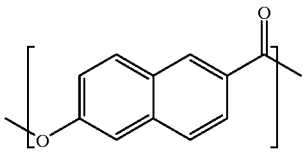

III is

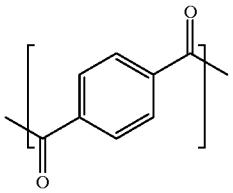

VII is

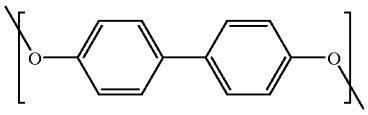

and
VI is

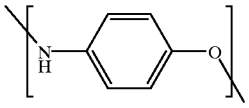

wherein said polyesteramide comprises about 40 to about 70 mole percent of moiety I, about 1 to about 20 mole percent of moiety II, about 14.5 to about 30 mole percent of moiety III, about 7 to about 27.5 mole percent of moiety VII, and about 2.5 to about 7.5 mole percent of moiety VI; and (v) a melt processable wholly aromatic polyesteramide capable of forming an anisotropic melt phase at a temperature below approximately 350° C. consisting essentially of the recurring moieties I, II, III, IV, V, and VI wherein:

I is

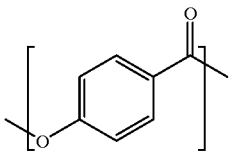

II is

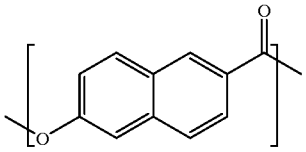

-continued

III is

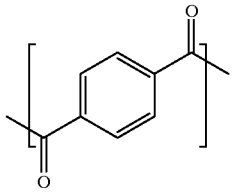

IV is

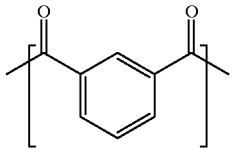

V is

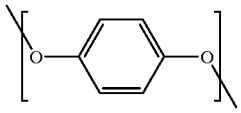

and
VI is

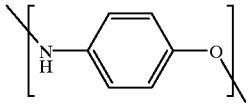

wherein said polyesteramide comprises about 40 to about 70 mole percent of moiety I, about 10 to about 20 mole percent of moiety II, about 2.5 to about 20 mole percent of moiety III, about 0 to about 3 mole percent of moiety IV, about 12.5 to about 27.5 mole percent of moiety V and about 2.5 to about 7.5 mole percent of moiety VI.

3. The filament as set forth in claim 1, wherein denier of said filament is from about 100 to about 1000 denier per filament.

4. The filament as set forth in claim 1, wherein denier of said filament is from about 150 to about 500 denier per filament.

5. The filament as set forth in claim 1, wherein denier of said filament is from about 180 to about 300 denier per filament.

6. A heat-treated multilobal filament of a thermotropic liquid crystalline polymer having the following properties:

(a) denier higher than 50 denier per filament;

(b) tenacity of at least about 20 grams per denier;

(c) modulus of at least about 500 grams per denier; and (d) elongation of at least about 3 percent.

7. The filament as set forth in claim 6, wherein said thermotropic liquid crystalline polymer is selected from the group consisting of:

(i) a melt processable wholly aromatic polyester capable of forming an anisotropic melt phase at a temperature below approximately 350° C. consisting essentially of the recurring moieties I and II wherein:

I is

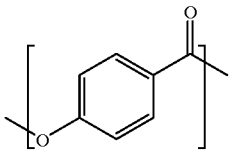

and
II is

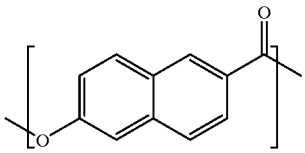

wherein said polyester comprises about 10 to about 90 mole percent of moiety I, and about 10 to about 90 mole percent of moiety II;

(ii) a melt processable wholly aromatic polyester capable of forming an anisotropic melt phase at a temperature below approximately 400° C. consisting essentially of the recurring moieties I, III, and VII wherein:

I is

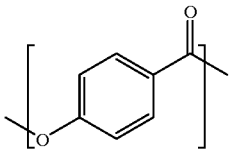

II is

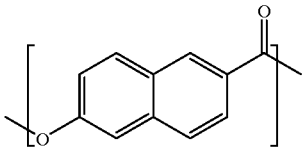

III is

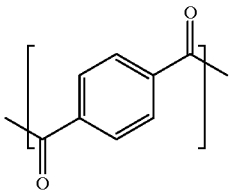

and
VII is

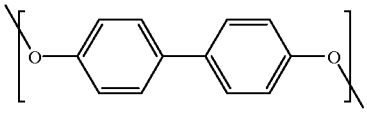

wherein said polyester comprises about 40 to about 70 mole percent of moiety I, about 1 to about 20 mole percent of moiety II, and about 14.5 to about 30 mole percent each of moieties III and VII;

(iii) a melt processable wholly aromatic polyesteramide capable of forming an anisotropic melt phase at a temperature below approximately 360° C. consisting essentially of the recurring moieties II, III, and VI wherein:

II is

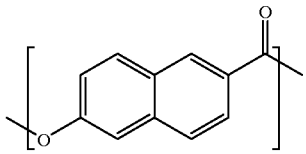

III is

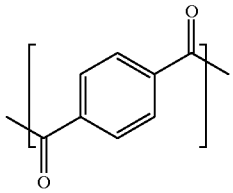

and
VI is

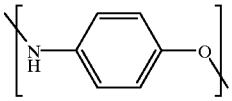

wherein said polyesteramide comprises about 40 to about 70 mole percent of moiety II, about 15 to about 30 mole percent each of moieties III, and VI;

(iv) a melt processable wholly aromatic polyesteramide capable of forming an anisotropic melt phase at a temperature below approximately 380° C. consisting essentially of the recurring moieties I, II, III, VII and VI wherein:

I is

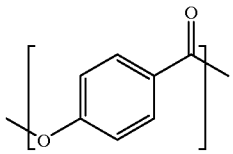

II is

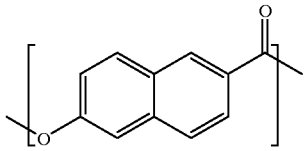

-continued

III is

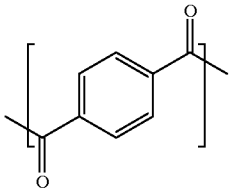

VII is

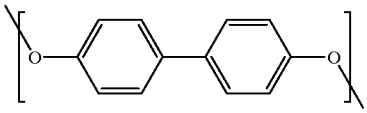

and
VI is

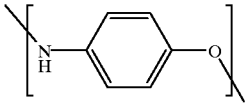

wherein said polyesterarnide comprises about 40 to about 70 mole percent of moiety I, about 1 to about 20 mole percent of moiety II, about 14.5 to about 30 mole percent of moiety III, about 7 to about 27.5 mole percent of moiety VII, and about 2.5 to about 7.5 mole percent of moiety VI; and (v) a melt processable wholly aromatic polyesteramide capable of forming an anisotropic melt phase at a temperature below approximately 350° C. consisting essentially of the recurring moieties I, II, III, IV, V, and VI wherein:

I is

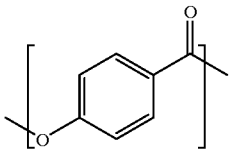

II is

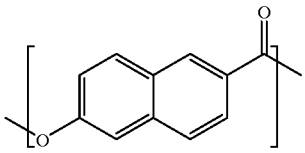

-continued

III is

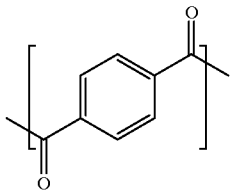

IV is

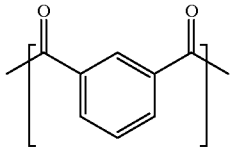

V is

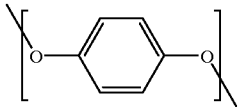

and
VI is

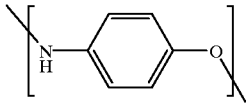

wherein said polyesteramide comprises about 40 to about 70 mole percent of moiety I, about 10 to about 20 mole percent of moiety II, about 2.5 to about 20 mole percent of moiety III, about 0 to about 3 mole percent of moiety IV, about 12.5 to about 27.5 mole percent of moiety V and about 2.5 to about 7.5 mole percent of moiety VI.

8. The filament as set forth in claim 6, wherein denier of said filament is from about 100 to about 1000 denier per filament.

9. The filament as set forth in claim 6, wherein denier of said filament is from about 150 to about 500 denier per filament.

10. The filament as set forth in claim 6, wherein denier of said filament is from about 180 to about 300 denier per filament.

* * * * *